United States Patent [19]

Brannan et al.

[11] 4,024,044

[45] May 17, 1977

[54] ELECTROLYSIS CATHODES BEARING A MELT-SPRAYED AND LEACHED NICKEL OR COBALT COATING

[75] Inventors: James R. Brannan, Painesville; Irving Malkin, University Heights, both of Ohio

[73] Assignee: Diamond Shamrock Corporation, Cleveland, Ohio

[22] Filed: Sept. 15, 1975

[21] Appl. No.: 613,576

[52] U.S. Cl. ..... 204/242; 428/679; 428/934; 156/654; 204/59 R; 204/290 R; 252/425.3; 429/44

[51] Int. Cl.[2] ..... C25B 11/06; B23P 3/00

[58] Field of Search ..... 204/59 R, 60, 290 R, 204/242, 292; 136/120 FC; 156/7; 429/40–45; 252/425.3; 29/196.6

[56] References Cited

UNITED STATES PATENTS

| | | | |
|---|---|---|---|
| 2,568,844 | 9/1951 | Benning et al. | 204/60 |
| 3,215,563 | 11/1965 | Clemm | 204/15 X |
| 3,248,787 | 5/1966 | Plust et al. | 136/120 FC |
| 3,403,057 | 9/1968 | Stankavich | 136/120 FC |
| 3,637,437 | 1/1972 | Goldberger | 136/120 FC |

FOREIGN PATENTS OR APPLICATIONS

| | | | |
|---|---|---|---|
| 278,644 | 8/1970 | U.S.S.R. | 204/59 F |

*Primary Examiner*—F.C. Edmundson
*Attorney, Agent, or Firm*—Theodore J. Dettling

[57] ABSTRACT

A cathode adapted for the electrolysis of water or an aqueous solution of an alkali metal halide salt because it gives prolonged lowering of hydrogen overvoltage is provided by an electrically conductive substrate bearing on its surface a coating produced by melt spraying an admixture of particulate nickel or cobalt and particulate aluminum and then leaching out the aluminum.

11 Claims, No Drawings

ELECTROLYSIS CATHODES BEARING A MELT-SPRAYED AND LEACHED NICKEL OR COBALT COATING

BACKGROUND OF THE INVENTION

This invention is directed to cathodes useful in the electrolysis of water containing an alkali metal hydroxide electrolyte or the electrolysis of aqueous solutions of alkali metal halide salts. More particularly it is directed to cathodes having a coating of foraminous nickel or cobalt formed by melt spraying and leaching that exhibits in those electrolytic processes reduced hydrogen overvoltage and good durability and life span.

In the electrolysis of water or aqueous alkali metal halide solutions in electrolytic cells having a diaphragm or membrane separator, the working voltage required comprises, in the main, the decomposition voltage of the compound being electrolyzed, the voltages required to overcome the ohmic resistances of the electrolyte and the cell electrical connections, and the potentials, known as "overvoltages," required to overcome the passage of current at the surfaces of the cathode and anode. Such overvoltage is related to factors as the nature of the ions being charged or discharged, the current per unit area of electrode surface (current density), the material of which the electrode is made, the state of the electrode surface (e.g. whether smooth or rough), temperature, and the presence of impurities in either the electrode or electrolyte. While various theories have been advanced to explain overvoltage, at the present time knowledge of the phenomenon is almost wholly empirical: it being observed that a characteristic overvoltage exists for every particular combination of discharging (or charging) ion, electrode, electolyte, current density, and so forth.

Because of the multi-million-ton quantity of chloroalkalies and water electrolyzed each year, even a reduction of as little as 0.05 volts in working voltage translates to meaningful economic savings especially with today's constantly increasing power costs. Consequently, the electrochemical industry has sought means to reduce the voltage requirements for such electrolytic processes. One means that has received attention is the provision of cathodes that have reduced hydrogen overvoltage: as, for example, cathodes made of or coated with sintered nickel or stell powder, or cathodes having particular metal- or metal alloy-coated surfaces. See, for example, U.S. Pat. Nos. 3,282,808, 3,291,714 and 3,340,294. However, such cathodes have not been adopted, it seems, to any significant degree, and steel cathodes still predominate. While the reasons for such nonuse are not clear, it may be that the costs of some, i.e., cost of producing and life span, versus realizable power savings, are unattractive. Another reason may be the inability of others to be readily fabricated. For example, sintered metal coatings are difficult to apply uniformly, especially to cathode substrates having irregular surfaces such as expanded or woven steel mesh.

SUMMARY OF THE INVENTION

Accordingly, it is an object of the present invention to provide cathodes particularly well suited for use in electrolyzing aqueous alkali metal halide solutions in cells having a diaphragm or membrane separator or for use in electrolyzing water, which cathodes have reduced hydrogen overvoltage, good life span, and the ability to be produced from a variety of cathode substrates into desired configurations.

A further object is the provision of bipolar electrodes for water electrolysis having, in addition to the aforedescribed cathode properties, excellent anode properties: particularly, low oxygen overvoltage and a long life span.

These and other objects and advantages, which will be apparent from the following description, are provided, it has been discovered, by cathodes comprising an electrically conductive substrate bearing on at least part of its surface a foraminous nickel or cobalt coating produced by a melt spraying an admixture of particulate nickel and/or cobalt and particulate aluminum and then leaching out the aluminum. Such cathodes, when used to electrolyze aqueous alkali metal halide salt solutions in cells having a diaphragm or membrane separator or when used to electrolyze water, (containing an alkali metal hydroxide electrolyte) reduce the hydrogen overvoltage of such processes about 0.05 to 0.15 volts, depending upon the cathode substrate and current density, and exhibit prolonged service life (i.e. running time during which the hydrogen overvoltage is less than that of the cathode substrate). Further, when such cathodes bear on both sides the foraminous nickel or cobalt coating, they may be used as bipolar electrodes in water electrolysis (using an alkali metal hydroxide electrolyte) to advantage because of their low anodic and cathodic overvoltages and good durability.

DESCRIPTION OF THE PREFERRED EMBODIMENTS

The cathode substrate may be any electrically conductive material having the needed mechanical properties and chemical resistance to the electrolyte solution in which it is to be used. Illustrative of materials that may be used are iron, mild steel, stainless steel, titanium, nickel, and the like. Normally, the cathode substrate will be foraminous (metal screen, expended metal mesh, perforated metal, and the like) to facilitate the generation, flow and removal of hydrogen gas formed during electrolysis at the cathode surface. Because of its low cost coupled with good strength and fabricating properties, mild steel is typically used as the cathode substrate, generally in the form of wire screen or perforated sheet. When the invention cathodes are to be used as a bipolar electrode in water electrolysis, solid gas-impermeable cathode substrates will be used.

Prior to being coated, the surfaces of the cathode substrate to be melt-sprayed are cleaned to remove any contaminants that could diminish adhesion of the coating to the cathode substrate by means such as vapor degreasing, chemical etching, sand or grit blasting, and the like, or combinations of such means. Good adhesion and low hydrogen overvoltage using steel substrates has been obtained with grit and sand blasting, and is generally used.

All or only part of the cathode surface may be coated depending upon the type of electrolytic cell in which the cathode is to be employed. For example, when the cathode is employed in halo-alkali cells wherein a diaphragm is deposited directly upon the side of the cathode facing the anode, then only the nonfacing side will normally be electrolytically active and, hence, need be coated. Conversely, when the cathode is used in halo-alkali cells having a diaphragm or membrane spaced apart from the cathode, both sides of the cathode may be coated. For water electrolysis, when used as a cathode both sides are normally coated, and when used as a bipolar electrode both sides are coated. The coating may be applied either before or after formation of the desired cathode configuration depending upon the accessability of the cathode surfaces to be coated to the metal spraying equipment and procedures and to leaching.

The particulate nickel or cobalt, used either singly or in combination, is preferrably in essence the neat metal (i.e., about 95% or more nickel or cobalt containing normally occurring impurities). Particulate nickel or cobalt alloys containing sufficient nickel or cobalt to give lowered hydrogen overvoltage, however, may also be used, as, for example, those containing about 50% by weight or more of nickel, cobalt, or mixtures of the two alloyed with materials that are essentially insoluble in aqueous alkali metal hydroxides, such as iron, copper and the like. Generally, particulate nickel or cobalt alloys are more costly and not as effective in lowering hydrogen overvoltage as the straight nickel or cobalt metal. Hence, if used as partial or complete replacement for the particulate nickel or cobalt metal, the composition, particle size, and quantity of any nickel or cobalt alloy used should be chosen so as to provide the decrease in hydrogen overvoltage desired. With respect to particle size, screened particulate nickel metal having particles within the range of 10 to 106 microns has been used while nickel alloys having a particule size range of 150 microns or less and similarily obtained by screening have been used. Better results were obtained with the particulate nickel metal when particles within the range of 10 to 45 microns were used. Particulate nickel or cobalt metal or alloy, or mixtures of these, having smaller or larger particle sizes should also be satisfactory, as can be readily ascertained. In the description and claims, the expression "particulate nickel or cobalt", or, alternatively, the expression "particulate nickel, cobalt, or mixtures thereof", hence, isused to describe both particulate nickel and/or cobalt metal and particulate alloys of nickel and/or cobalt of the character hereinbefore described or mixtures thereof having the ability to provide cathode coating having lowered hydrogen overvoltage after the aluminum has been leached out.

The particulate aluminum employed had a typical particle size range of 45–90 microns (screen classified), and was 99 percent pure metal. Particulate aluminum materials having different compositions and particle sizes should be equally suitable so long as they are leachable and provide coated cathodes having after leaching the desired decrease in hydrogen overvoltage, and the expression "particulate aluminum" is employed herein and in the claims to describe such materials.

In the admixture of particulate components that is melt sprayed, the weight ratio of nickel or cobalt to aluminum is such that the particulate nickel or cobalt constitutes about 50–95%, about 67–90% appearing to be optimium, and the particulatealuminum about 50–5% of the combined weights of nickel or cobalt and aluminum powders used in the coating admixture. Outside these ranges, hydrogen overvoltage rises to unacceptable levels and/or durability of the coating is lessened, thus diminishing the effective life span of the cathode.

Diluent materials, such as particulate iron, tin, aluminum oxide, titanium dioxide, Raney nickel alloy and the like, may be admixed and melt sprayed with the admixture of particulate nickel or cobalt and particulate aluminum in minor quantities (i.e., constitute less than 50% by weight of the total coating components). Generally, however, no advantage accrues from their use and, if used, the composition, quantity and particle size of such diluent materials should be selected so as to maintain the desired decrease in hydrogen overvoltage.

Significant lowering of hydrogen overvoltage is obtained when as little as 3–4 mils of the invention coating is applied to the cathode substrate. However, for good durability and life span, a coating thickness of about 5 mils or more is typically used. Usually, the invention coating thickness will not exceed about 15 mils because of increased costs with no apparent attendant advantage. For maximum uniformity, coatings are best produced by multiple spray pass applications with each pass depositing typically about a 1.25 to 5 mil coating. The thicknesses described herein and in the following examples relate to the thicknesses of the sprayed coatings before the aluminum is leached out.

The cathode coating is applied by melt spraying the admixture of particulate nickel or cobalt and particulate aluminum with an essentially nonoxidizing melting and spraying gas stream, using spraying parameters that deposit the particulate coating constituents upon the cathode substate substantially in melted form.

Such melt spraying is readily and efficaciously achieved by means such as flame spraying or by plasma spraying. In flame spraying the particulate coating constituents are melted and sprayed in the stream of a burning flame of a combustible organic gas, usually acetylene, and an oxidizing gas, usually oxygen, employed in a ratio that gives a nonoxidizing flame (i.e., the quantity of oxidizing gas is stoichiometrically less than that required for complete oxidation of the combustible fluid). In plasma spraying, the particulate coating constituents are melted and sprayed in a plasma stream generated by heating with an electric arc to high temperatures an inert gas, such as argon or nitrogen, optionally containing a minor amount of hydrogen.

The spraying parameters, such as the volume and temperature of the flame or plasma spraying stream, the spraying distance, the feed rate of particulate coating constituents and the like, are chosen so that the particulate components of the coating admixture are melted by and in the spray steam and deposited on the cathode substrate while still substantially in melted form so as to provide an essentially continuous coating (i.e. one in which the sprayed particles are not discernible) having a foraminous structure. Typically, spray parameters like those used in the examples give satisfactory coatings. Usually, slightly better results with respect to decreased hydrogen overvoltage are obtained by maintaining the cathode substrate during melt spraying near ambient temperature. This may be achieved by means such as streams of air impinging on the substrate during spraying or allowing the substrate to air cool between spray passes.

After being melt sprayed, the coated cathode is immersed in an alkaline solution that solvates and leaches out virtually all of the aluminum component of the coating. The type and concentration of the alkaline solution and the leaching parameters of time and temperature are not particularly critical. Typical alkaline solutions that may be used are 10–20 percent aqueous solutions of sodium or potassium hydroxide. Typical leaching conditions that may be used are temperatures ranging from 25°–80° C for 16 hours or more. Longer leaching times are required for weak alkaline solutions and/or low temperatures. Usually, most of the aluminum is leached out prior to placing the coated cathode into service, with any residual soluble aluminum being leached out by electrolyte during subsequent use of the cathode. Alternatively, leaching may be accomplished in an electrolytic cell with alkali metal hydroxide either initially present (water electrolysis cells) or generated during electrolysis (haloalkali cells). However, this method contaminates the electrolyte with more aluminum ions and is less preferred.

The coated cathodes of the present invention are, as previously described, particularily suitable for haloalkali cells that have either a diaphragm or membrane separator and are used to electrolyze aqueous alkali metal halide solutions to the corresponding alkali metal hydroxide and halogen according to conventional procedures known to the art. While useful for any alkali metal halide, as a practical matter, they will normally be employed in the electrolysis of sodium or potassium chloride. Also the invention coated cathodes are well adapted for use as the cathode and/or anode in unipolar water electrolyzers or as bipolar electrodes in bipolar water electrolyzers when such devices employ an alkali metal hydroxide as electrolyte, because of their decreased hydrogen overvoltage and/or low oxygen overvoltage for prolonged periods of service. Such water electrolyzers and processes are, in other respects, conventional and known to the art. See, for example, "Water Electrolysis", 1,156–1,160, *Encyclopedia of Electrochemistry*.

When the invention cathode is to be utilized in haloalkali cells having a diaphragm directly deposited on the cathode from an aqueous slurry of suitable fibers (usually asbestos), it will generally be found advantageous to leach out the aluminum prior to forming the diaphragm so as to minimize the chance of damage to the diaphragm or loss of coherence of the diaphragm to the cathode, which might occur during leaching. Furthermore, it has been observed that some coatings after leaching, when heated in air at elevated temperatures such as 280° C or more, increase in hydrogen overvoltage. Hence, whenever it is desired to heat the coated cathodes after leaching, as for example to set (by fusing) an asbestos fiber diaphragm deposited thereon that contains thermoplastic fibers, such heating may best be accomplished by heating in an inert gas environment, such as nitrogen, argon and the like, to minimize possible hydrogen overvoltage increases.

Unlike the Raney nickel or cobalt sheets described in U.S. Pat. No. 3,637,473, which are produced by plasma spraying particulate Raney nickel or cobalt alloys (containing 45–55% nickel or cobalt and 55–45% aluminum) and then leaching out the aluminum, the coated cathodes of the present invention exhibit little if any pyrophoric character (i.e., are essentially nonphyrophoric) when exposed to oxygen or air.

Further it has been determined that a coating produced by melt spraying an admixture consisting of essentially nickel and aluminum powders (i.e., containing no particulate Raney nickel alloy diluent) contains no detectable (by X-ray defraction) Raney nickel alloy, and that heating such a melt-sprayed coating either in air or hydrogen for one hour at 700° C, while generating some detectable alloy, does not significantly change cathode potential after leaching.

EXAMPLES 1–12

Test specimens (1×3 inches) of steel wire screening (No. 6 mesh) were grit-blasted and melt sprayed on both sides with the coatings shown in Table 1. Melt spraying was done either by flame or plasma spraying as indicated. In plasma spraying, the specimens were cooled during spraying by impinging streams of air surrounding the spray pattern. In flame spraying, the test specimens were allowed to air cool between spray passes. Four spray passes were used per side to deposit coatings having average thicknesses within the range of 5–10 mils.

Flame spraying was done with a Metco 5P spray gun equipped with a P7G nozzle using the following average spraying parameters:
Acetylene: 33 ft.$^3$/hr. at 13 psi
Oxygen: 60 ft.$^3$/hr. at 20 psi
Coating feed rate: About 100 g/minute
Spray distance 5–7 inches.

Plasma spraying was done with a Metco 3MB spray gun equipped with a G nozzle and a No. 2 powder port using the following average spraying parameters:
Nitrogen: 150 ft.$^3$/hr. at 50 psi
Hydrogen: 10 ft.$^3$/hr. at 50 psi
Coating feed rate: About 80 g/minute
Arc voltage and current: 65–70 volts and 400 amps
Spraying distance: 4–6 inches.

After being melt sprayed, the cathodes were immersed in 10% aqueous sodium hydroxide at room temperature for at least 16 hours to leach out the aluminum. After 16 hours little if any hydrogen evolution was discernible.

Cathode potential was determined by immersing an 1 × 1 inch area of the coated and leached cathode test specimen into 90° C aqueous NaOH (100 gpl) with one of the coated sides facing an immersed dimensionally stable anode (one square inch immersed area), and determining, with a saturated calomel electrode through a Luggin capillary, the potential at the center of the coated cathode surface at currents of 1, 2, 3 and 4 amperes between the cathode and the anode. The potential of an uncoated control of the No. 6 mesh screen which had been sand blasted was similarily determined.

The hydrogen overvoltage decrease shown in Table 1 and referred to in the description is simply the difference at any given current density between the potential of an uncoated cathode substrate and the potential of the same cathode substrate after being coated and leached, and generally will be at least about 0.05 volts at a cathode current density of one ASI when the invention coating (5 mils or more thickness) is applied to a No. 6 mesh steel screen cathode substrate.

From the data in Table 1, it can be seen that the particular coatings utilized in Examples 1–12 decreased hydrogen overvoltage from 0.05 to 0.16 volts, that the plasma spraying employed seems to be somewhat better than the flame spraying employed, that fine nickel metal powder (10–45 microns) is slightly better in lowering hydrogen overvoltage than the coarser material (45–106 microns), and that particulate nickel-iron alloys can be employed in place of nickel metal powder, although at a sacrifice in observed lowering of hydrogen overvoltage.

In other tests employing some of the coating compositions and spraying and leaching parameters of Examples 1–12, it was observed that similar results are obtained when a perforated steel plate is used as the cathode substrate. However, the decrease in hydrogen overvoltage was less.

Contrary to the results obtained in Examples 1–12, cathodes prepared with plasma-sprayed admixtures of particulate iron and aluminum (50/50, 67/33 and 80/20) upon a No. 6 wire mesh substrate give, after leaching, potentials the same as or only slightly lower (0.01 to 0.04 volts less) than those of the uncoated substrate.

EXAMPLE 13

A 2.31 inch diameter cathode test specimen of No. 6 mesh steel wire screen, which had been cleaned by grit blasting, was coated on one side by multiple plasma spray passes while concurrently air cooling the speciman until a coating of 5+ mils was obtained. The coating composition melt sprayed was a homogeneous admixture of 80% particulate nickel (Metco 56F-NS) and 20% particulate aluminum (Metco 54). The aluminum was then leached out by immersing the coated cathode in 10% aueous sodium hydroxide for about 16 hours. The uncoated side of cathode test speciman was covered with an asbestos fiber diaphragm modified with polytetrafluoroethylene fibers, and the resulting asbestos diaphragm-covered cathode placed in a laboratory diaphragm cell that was used to electrolyze aqueous sodium chloride under the following average conditions: current density of 1 ASI, catholyte temperature of 65°–75° C, anolyte brine concentration of 310 gpl (acidified with HCl to a pH of about 2), and catholyte caustic concentration of 130–140 gpl. As compared to an equivalent diaphragm cell similarly operated and equipped with a No. 6 mesh steel screen cathode that had been sandblasted only and gave potentials of 1.29 ±0.01 volts during the test period, the invention coated cathode reduced hydrogen overvoltage initially 0.11 volts, and after running virtually continuously for twelve months, still exhibited the same lowered potential (1.18 volts) with no apparent signs of incipient failure.

A second cathode, similarly prepared and tested, made by melt spraying a coating composition of 67% particulate nickel metal (Metco 56 F-NS) and 33% particulate aluminum (Metco 54) had potentials of 1.17 volts initially and 1.21 volts after 12 months and showed no signs of failing. In both tests the potentials were determined against a saturated calomel electrode.

EXAMPLE 14

Two test specimens, each 1 × 3 inches, were cut from a No. 6 steel wire mesh cathode substrate that had been grit blasted and plasma sprayed on both sides with a coating composition consisting of a homogeneous admixture of 80% particulate nickel (Metco 56F-NS) and 20% particulate aluminum (Metco 54). Four spray passes were used per side to give coatings having an average thickness of about 5 mils. During spraying the substrate was cooled with impinging streams of air surrounding the spray pattern. After being cut from the sprayed cathode substrate, the test specimens were immersed in 10% NaOH for 16 hours to leach out substantially all of the aluminum.

When employed as the electrodes in the electrolysis of aqueous NaOH (100 gpl and 90° C) at current densities of 1, 2, 3 and 4 ASI, the following potentials versus a saturated calomel electrode were observed: anode = 0.39, 0.41, 0.43 and 0.44 volts; cathode = 1.09, 1.12, 1.14 and 1.16 volts. The specimens were then utilized as unipolar electrodes in a water electrolyzer employing: aqueous NaOH electrolyte maintained at about 100 gpl concentration by the addition of water, temperature of about 25°–30° C, and a current density of 3 ASI. After running virtually continuously for 65 days, the specimens were removed and the potentials redetermined using the same pretest conditions. The anode specimen had potentials of 0.38, 0.40, 0.41 and 0.43 volts, while the cathode specimen had potentials of 1.12, 1.15, 1.17 and 1.19 volts.

From the foregoing, it can be seen that the invention electrode when used for water electrolysis exhibits and essentially constant anodic potential, and only a 0.03 volt increase in cathode potential. As compared to the uncoated steel mesh control shown in the Table, the cathode potential after 65 days represents meaningful hydrogen overvoltage decreases of 0.09, 0.10, 0.11 and 0.12 volts at current densities of 1, 2, 3 and 4 ASI. cl

EXAMPLE 15

A plurality of test specimens, each 1 × 3 inches, were cut from a No. 6 steel wire mesh cathode substrate that had been grit blasted and plasma sprayed on one side with a coating composition consisting of a homogeneous admixture of 67% particulate nickel (Metco 56 F-NS) and 33% particulate aluminum (Metco 54). Two spray passes were used to give a coating having an estimated thickness of about 6–8 mils. During spraying the substrate was cooled with impinging streams of air surrounding the spray pattern. After being cut from the sprayed cathode substrate, some of the test specimens were heated in air or hydrogen at 700° C for one hour. After heating, some of the heated specimens and some unheated specimens were leached by immersion in 10% NaOH at ambient temperature for at least 16 hours, and their cathode potential determined by the method employed in Examples 1–12. Further, the components present in the coatings of the various specimens (i.e. both untreated and heat treated, and leached and unleached) were determined by X-ray defraction analysis. The results of these tests are compiled in Table 2.

The data in Table 2, indicates that no detectable Raney nickel alloy ($NiAl_3$ and/or $Ni_2Al_3$) is present in a melt-sprayed nickel-aluminum coating; and that heating the coating in air or hydrogen, while producing a detectable quantity of a Raney nickel alloy ($Ni_2Al_3$), has no significant effect on lowering hydrogen overvoltage. These data were obtained by analyzing the coatings of specimens A to F at ambient temperatures in air with a Philips Norelco X-ray diffraction unit having a copper-target X-ray tube and a graphite-focusing monochromator/scintillation detector. The tube was operated at 40 kilovolts and 20 milliamperes, while the diffractometer was run at a scan speed on 1° (2θ) per minute.

TABLE 1

| Example | Sprayed[1] Cathode Coating | Melt Spraying Method Used | Cathode[2] Potential | Hydrogen Overvoltage Decrease (Volts) |
|---|---|---|---|---|
| Control | None | — | 1.21 | — |
| | | | 1.25 | — |
| | | | 1.28 | — |
| | | | 1.31 | |
| 1 | Nickel - 67% Aluminum - 33% | Flame | 1.13 | .08 |
| | | | 1.18 | .07 |
| | | | 1.22 | .06 |
| | | | 1.24 | .07 |
| 2 | Nickel - 80% | Flame | 1.10 | .11 |

TABLE 1-continued

| Example | Sprayed[1] Cathode Coating | Melt Spraying Method Used | Cathode[2] Potential | Hydrogen Overvoltage Decrease (Volts) |
|---|---|---|---|---|
| | Aluminum - 20% | | 1.13 | .12 |
| | | | 1.16 | .12 |
| | | | 1.19 | .12 |
| 3 | Nickel - 90% | Flame | 1.13 | .08 |
| | Aluminum - 10% | | 1.17 | .08 |
| | | | 1.20 | .08 |
| | | | 1.22 | .09 |
| 4 | Nickel - 50% | Plasma | 1.11 | .10 |
| | Aluminum - 50% | | 1.14 | .11 |
| | | | 1.16 | .12 |
| | | | 1.18 | .13 |
| 5 | Nickel - 67% | Plasma | 1.11 | .10 |
| | Aluminum - 33% | | 1.15 | .10 |
| | | | 1.17 | .11 |
| | | | 1.19 | .12 |
| 6 | Nickel - 80% | Plasma | 1.09 | .12 |
| | Aluminum - 20% | | 1.11 | .14 |
| | | | 1.13 | .15 |
| | | | 1.15 | .16 |
| 7 | Nickel - 90% | Plasma | 1.08 | .13 |
| | Aluminum - 10% | | 1.10 | .15 |
| | | | 1.13 | .15 |
| | | | 1.16 | .15 |
| 8 | Nickel - 67% | Plasma | 1.08 | .13 |
| | Aluminum - 33% | | 1.13 | .12 |
| | | | 1.17 | .11 |
| | | | 1.19 | .12 |
| 9 | Nickel - 80% | Plasma | 1.10 | .11 |
| | Aluminum - 20% | | 1.16 | .09 |
| | | | 1.19 | .09 |
| | | | 1.23 | .08 |
| 10 | Nickel - 90% | Plasma | 1.12 | .09 |
| | Aluminum - 10% | | 1.17 | .08 |
| | | | 1.19 | .09 |
| | | | 1.22 | .09 |
| 11 | Nickel-Iron | Plasma | 1.11 | .10 |
| | Alloy (80:20) - 80% | | 1.16 | .09 |
| | Aluminum - 20% | | 1.18 | .10 |
| | | | 1.20 | .11 |
| 12 | Nickel-Iron | Plasma | 1.16 | .05 |
| | Alloy (50:50) - 80% | | 1.18 | .07 |
| | Aluminum - 20% | | 1.19 | .09 |
| | | | 1.20 | .11 |

[1]The melt-sprayed cathode coating compositions were homogeneous admixtures of the following metal powders obtained from Metco Inc. of Westburry L.I., N.Y. or Ventron Corp. of Danvers, Mass.:

a) Metco 54 particulate aluminum (45–90 microns) used in all the Examples.

b) Metco 56 F-NS particulate nickel metal (10–45 microns) used in Examples 1–7.

c) Metco XP 1104 particulate nickel metal (45–106 microns) used in Examples 8–10.

d) Ventron particulate nickel-iron alloys (up to 150 microns) used in Examples 11 & 12.

[2]Volts at 1, 2, 3 and 4 amperes current density per square inch of immersed cathode.

TABLE 2

| Example 15 Specimen | Heat Treatment[1] | Leached | Cathode Potential | Coating Components[2] |
|---|---|---|---|---|
| A | None | No | — | Ni, NiO, Fe, Al, —, — |
| B | " | Yes | 1.10 | Ni, NiO, —, —, NiAl, — |
| | | | 1.13 | |
| | | | 1.16 | |
| | | | 1.17 | |
| C | 1 hr C 700° in air | No | — | Ni, NiO, —, Al, —, $Ni_2Al_3$ |
| D | " | Yes | 1.11 | Ni, —, Fe, —, NiAl, $Ni_2Al_3$ |
| | | | 1.12 | |
| | | | 1.14 | |
| | | | 1.15 | |
| E | 1 hr. C 700° C in $H_2$ | No | — | Ni, —, —, —, NiAl, $Ni_2Al_3$ |
| F | " | Yes | 1.13 | Ni, NiO, —, —, —, $Ni_2Al_3$ |
| | | | 1.15 | |
| | | | 1.16 | |
| | | | 1.18 | |

[1]Specimens heated in hydrogen were actually heated for more than one hour due to the additional time required to heat and cool the specimens in the hydrogen atmosphere to and from the 700° C treatment temperature.

[2]Elements or compounds detected by x-ray defraction.

What is claimed is:

1. A cathode for the electrolysis of water or an aqueous alkali metal halide solution which comprises an electrically conductive substrate bearing on at least part of its surface a coating produced by melt spraying an admixtutre consisting essentially of particulate nickel, cobalt, or mixtures thereof, and particulate aluminum; and leaching out the aluminum from the melt-sprayed coating; said coating, before leaching, being substantially devoid of X-ray-detectable Raney metal alloy formed from melt spraying the particulate nickel or cobalt and particulate aluminum.

2. The cathode of claim 1 in which the admixture consists essentially of about 50–95% by weight of particulate nickel, cobalt, or mixtures thereof, and about 50–5% by weight of particulate aluminum.

3. The cathode of claim 2 in which the substrate is steel.

4. The cathode of claim 1 in which the admixture consists essentially of about 67–90% by weight of particulate nickel, cobalt, or mixtures thereof, and about 33–10% by weight of particulate aluminum.

5. The cathode of claim 1 in which the admixture consists essentially of about 67–90% by weight of particulate nickel and about 33–10% by weight of particulate aluminum.

6. The cathode of claim 5 in which the substrate is steel.

7. The cathode of claim 1 in which the admixture consists essentially of about 67–90% by weight of particulate cobalt and about 33–10% by weight of particulate aluminum.

8. In a halo-alkali electrolysis cell having a separator, the improvement which comprises the cathode of claim 2.

9. In a halo-alkali electrolysis cell having a separator, the improvement which comprises the cathode of claim 5.

10. In a water electrolyzer, the improvement which comprises the cathode of claim 2.

11. A method for producing a cathode for the electrolysis of water or an aqueous alkali metal halide solution which comprises:

A. melt spraying upon the surface of an electrically conductive substrate an admixture consisting essentially of about 50–95% by weight of particulate nickel, cobalt or mixtures thereof and about 50–5% by weight of particulate aluminum; and B. leaching out the aluminum from the melt-sprayed coating.

* * * * *

UNITED STATES PATENT OFFICE
CERTIFICATE OF CORRECTION

PATENT NO. : 4,024,044

DATED : May 17, 1977

INVENTOR(S) : James R. Brannan and Irving Malkin

It is certified that error appears in the above-identified patent and that said Letters Patent are hereby corrected as shown below:

Col. 1, line 48 - "stell" should be -steel-.

Col. 2, line 39 - "expended" should be -expanded-.

Col. 3, line 38 - "isused" should be -is used-; line 59 - "particulatealuminum" should be -particulate aluminum-.

Col. 7, line 22 - "aueous" should be -aqueous-.

Col. 8, line 13 - "and" should be -an-; line 19 - after "ASI." cancel "cl"; line 55 - "on" should be -of-.

Col. 10, line 3 - "admixtutre" should be -admixture-.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*